United States Patent [19]

Wilhelm et al.

[11] Patent Number: 4,852,850

[45] Date of Patent: Aug. 1, 1989

[54] VALVE SYSTEM WITH ADJUSTABLE SEATING FORCE

[75] Inventors: Peter L. Wilhelm; Gilbert F. Hyde, both of Winter Springs, Fla.

[73] Assignee: Westinghouse Electric Corp., Pittsburgh, Pa.

[21] Appl. No.: 49,364

[22] Filed: May 14, 1987

[51] Int. Cl.[4] ..... F16K 31/122

[52] U.S. Cl. ..... 251/28; 251/175; 251/31

[58] Field of Search ..... 251/28, 31, 158, 175

[56] References Cited

U.S. PATENT DOCUMENTS

| | | | |
|---|---|---|---|
| 1,721,324 | 7/1929 | Wilson | 251/158 |
| 2,707,378 | 5/1955 | Ryan | 251/158 X |
| 3,656,707 | 4/1972 | Marotta | 251/158 X |
| 3,684,236 | 8/1972 | Lewis | 251/28 |
| 3,814,375 | 6/1974 | Grotloh | 251/31 X |
| 3,858,844 | 1/1975 | Lewis et al. | 251/28 |
| 3,892,382 | 7/1975 | Dresner | 251/28 |
| 4,019,712 | 4/1977 | Martin | 251/26 |
| 4,070,000 | 1/1978 | Prescott | 251/26 |
| 4,552,330 | 11/1985 | Grothloh | 251/31 X |
| 4,589,627 | 5/1986 | Grotloh | 251/31 X |

*Primary Examiner*—Arnold Rosenthal

[57] ABSTRACT

A steam bypass valve system for a steam turbine. The system provides a supplemental hydraulic seating force to a fast acting bypass valve after the valve plug is positioned against the valve seat with a spring force. The system also provides for quick hydraulic relief in order to retain the fast opening characteristics of a single acting hydraulic valve.

5 Claims, 3 Drawing Sheets

VALVE SYSTEM WITH ADJUSTABLE SEATING FORCE

FIELD OF THE INVENTION

This invention relates to valve actuator systems and, more particularly, to a system for controlling valve seating force.

BACKGROUND OF THE INVENTION

In a conventional steam turbine electric power plant, steam flowing from a steam generator to a high pressure turbine element is regulated by a main control valve and serially connected throttle valve in order to govern the flow of steam into the high pressure turbine. The normally open control valve is switched from an open to a closed position whenever the turbine reaches a predetermined overspeed condition caused by a sudden loss of load in the generator electrical system or the failure of a component in the steam system. Seating of the main control valve blocks the flow of high temperature steam from the steam generator to the turbine. When the main control valve is suddenly closed, an alternate steam flow path must be provided in order to prevent steam pressure from exceeding maximum limits. A fast opening bypass valve which is quickly responsive to a trip signal is used to redirect the steam flow directly to the condenser whenever the main control valve is closed.

FIG. 1 illustrates in a simplified manner the relationship between a bypass valve (20) and a main control valve (22). The throttle valve can be assumed to be incorporated in the control valve 20. With the bypass valve closed, steam travels from the steam supply system through the control valve (22) and into the high pressure turbine element 24. Steam exits the turbine and passes through condenser 26 before returning to the steam supply system 28 for reheating.

During startup as well as during normal operation it is necessary that the bypass valve be smooth opening and responsive to changes in flow through the turbine. In general, the bypass valve operates in conjunction with the control valve to regulate main steam pressure, i.e., if steam flow through the turbine is reduced, the bypass valve is opened sufficiently to maintain the steam pressure relatively constant at the control valve. The bypass valve is used at start-up to provide the minimum required flow through the steam generator.

While bypass valve design and operation are critical in any steam turbine, such features are particularly important in nuclear steam turbine systems which operate at lower pressure levels than conventional fossil fuel systems and therefore require that relatively higher volumes of steam be supplied to the turbine in order to achieve desired output levels. Therefore, both the control valves and the bypass valves found in nuclear systems are larger than their fossil system counterparts. This sizing requirement of a bypass valve in combination with requirements that it be both fast opening and smoothly controllable has presented some unique problems. For example, many bypass valves have experienced steam leakage while in a closed state. Although such leakage initially has only a minor effect on system performance, continued leakage erodes the valve seat leading to significant system deterioration and requiring valve replacement.

The leakage problem has been determined to be resolvable by increasing the valve seating force at closing. However, the requirements that the valve be fail-safe and be rapid opening prohibit conventional solutions for increasing valve seating force. For example, an increase in spring closing force or use of a double acting hydraulic valve are not appropriate since these solutions have a negative effect on the required fast opening and fail-safe characteristics. Although the leakage problem is believed to be generally common to bypass valves generally, it is believed that the problem also occurs in valves containing flexible seats since such seats exert two variable forces against the closing spring. In such valves, a valve plug presses against a flexible seat causing deflection from a relaxed position to a deflected position. The deflected seat exerts an opposing spring force which increases with the deflection. Furthermore, as the seat deflects and moves away from a relaxed position, a greater surface area of the valve seat becomes exposed to the pressure differential between the valve inlet and valve outlet. As a result, the unbalanced force of the steam against the seat increases as the plug deflects the seat. This force is transferred to the closing spring making it more difficult to properly seat the valve plug. These same effects are present to a lesser degree in fixed valve seats.

SUMMARY OF THE INVENTION

Among the several objects of the invention may be noted the provision of an improved valve control system and a method for eliminating leakage of fluid under the control of a normally closed valve which overcome the above discussed disadvantages, limitations or undesirable features, as well as others, of the prior art; the provision of such improved valve design and method which introduces an additional closing force after the valve plug has been moved to the closed position, there being provided a readily adjustable force to hold the valve plug firmly in the closed position; the provision of such improved valve design including a means for removing the additional closing force so that the valve may be quickly opened or modulated; the provision of such an improved valve design and method for eliminating leakage which introduce no limiting effects on either the opening or closing characteristics of the valve or on the modulating characteristics of the valve; the provisions of such method being applicable to any valve design or system which requires tight seating of a valve plug; the provisions of such improved valve design being readily retrofittable onto any existing single acting hydraulic system which relies upon spring forces to seat the valve plug; the provisions of such method and improved valve design including the ability to reduce the amount of steady state spring force otherwise required for seating of a valve plug thus improving the opening and control characteristics of the valve, allowing for a reduction of the opening force, a reduction in the size of closing springs and a reduction in the size of hydraulic actuating cylinders.

Generally, there is provided a method for eliminating leakage of high pressure fluid during operation of a fast opening valve, the valve comprising at least one valve plug movable to a closed position by a closing spring, wherein an additional seating force is applied after the valve plug is moved to the seat by the spring force.

Specifically, there is provided an improved valve control and operating system for eliminating leakage through a valve of the fluid being controlled. In a preferred embodiment the valve system comprises an improvement over single acting hydraulic valve systems by hydraulically providing a second seating force after the valve plug is positioned against the valve seat and further providing a dump valve for quickly relieving the hydraulic second seating force in order to retain the opening characteristics of a single acting hydraulic valve.

DETAILED DESCRIPTION

The inventive method and valve system are described by way of example with particular application to control of high pressure steam flow in a steam turbine electric power generating system. It is to be understood that the invention will be useful in any valve system requiring seating forces which do not adversely affect opening characteristics. Although the advantages of the invention are described with reference to a flexible valve seat it is also clear that the improved valve system and method applies to valves having fixed seats.

Figure 1:
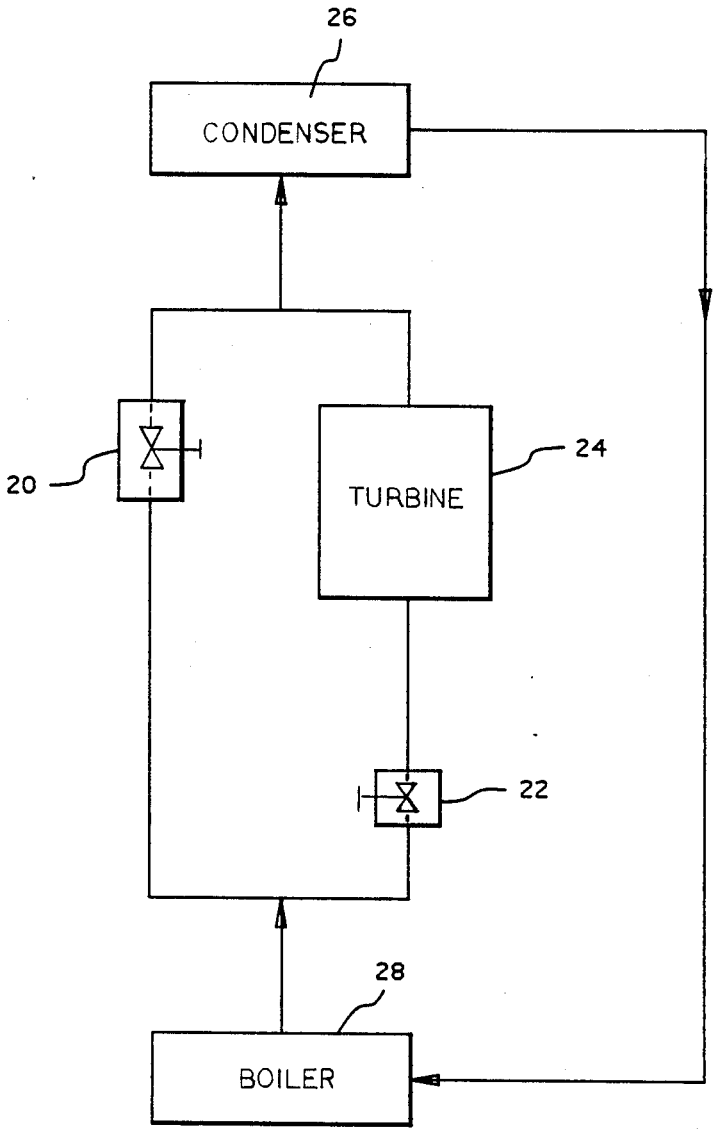
FIG. 1. (PRIOR ART)
FIG. 1 is a diagrammatic view indicating the location of a bypass valve in a steam turbine system.
Figure 2:
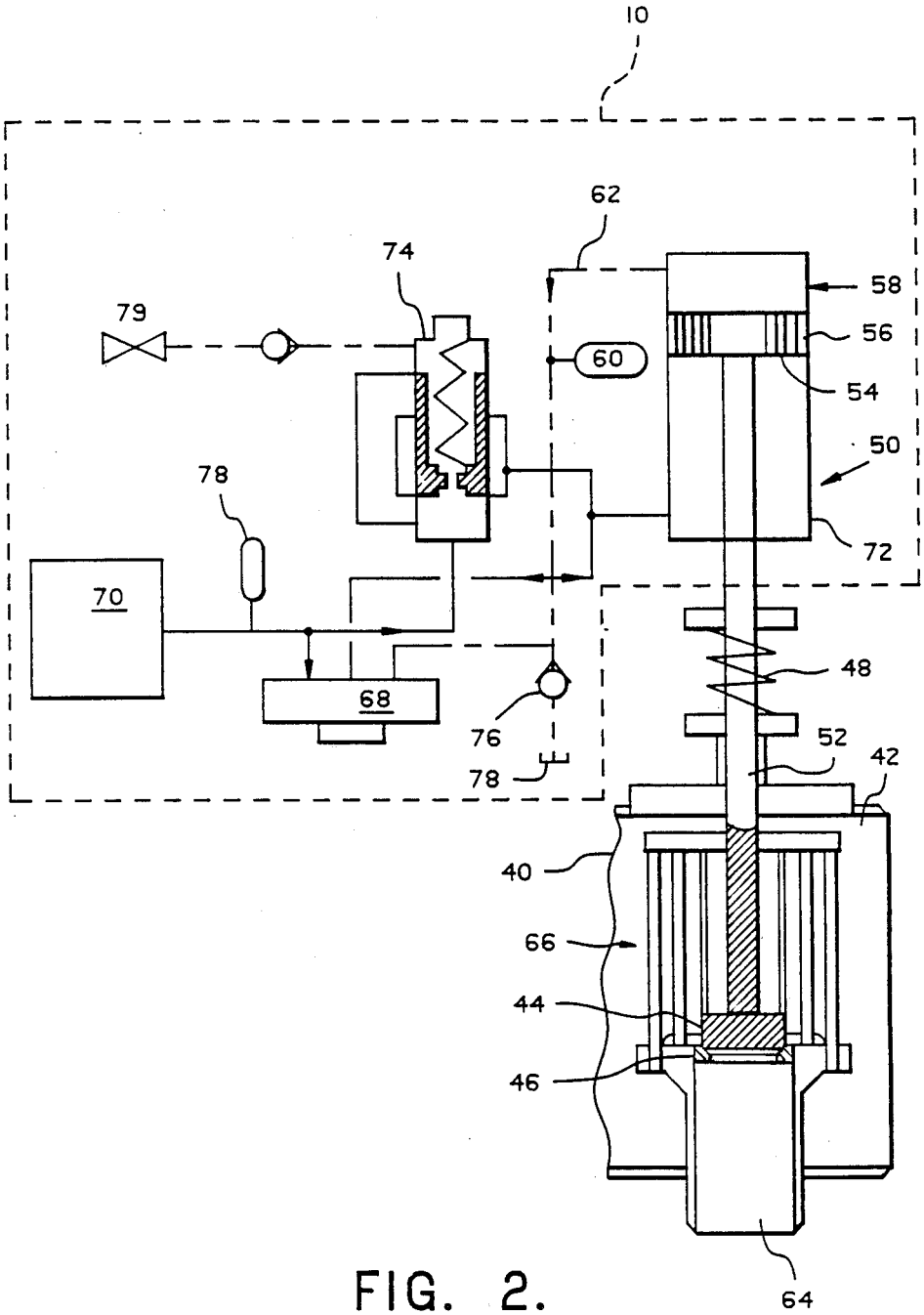
FIG. 2. (PRIOR ART)
FIG. 2 is a simplified schematic of a conventional single acting hydraulic valve system.

Referring first to FIG. 2, there is illustrated in simplified schematic form a conventional single acting hydraulic valve system 10 of a type well known in the art which, for purposes of description, will be treated as a bypass valve system. The bypass valve 40 is a normally closed, single acting hydraulic valve comprising a body member 42 having a valve plug 44 positionable against a flexible valve seat 46 by the closing force of a spring 48 and the weight of moving parts of the valve. A plug 44 is positionable by a hydraulic cylinder 50. A valve stem 52 connects the plug 44 to a first side 54 of a piston 56 in a cylinder 50. Application of hydraulic pressure to the first side 54 of the piston moves the piston to a first end 58 of the cylinder to open the valve. Any fluid leakage above the piston 56 escapes to a drain accumulator 60 via hydraulic lines 62. With the valve 40 in this open position, high pressure steam enters the valve inlet 64 and exits through the valve outlet 66 directly to the condenser 26 illustrated in FIG. 1. A servovalve 68 controls the flow of hydraulic fluid from a fluid supply 70 into and out of a second end 72 of the cylinder 50 in order to selectively apply a valve opening force to the piston 56. A dump trip valve 74 is positioned in parallel with the servovalve 68 in order to effect rapid insertion of fluid to the second end 72 of the cylinder to quickly open the valve 40.

Figure 3:
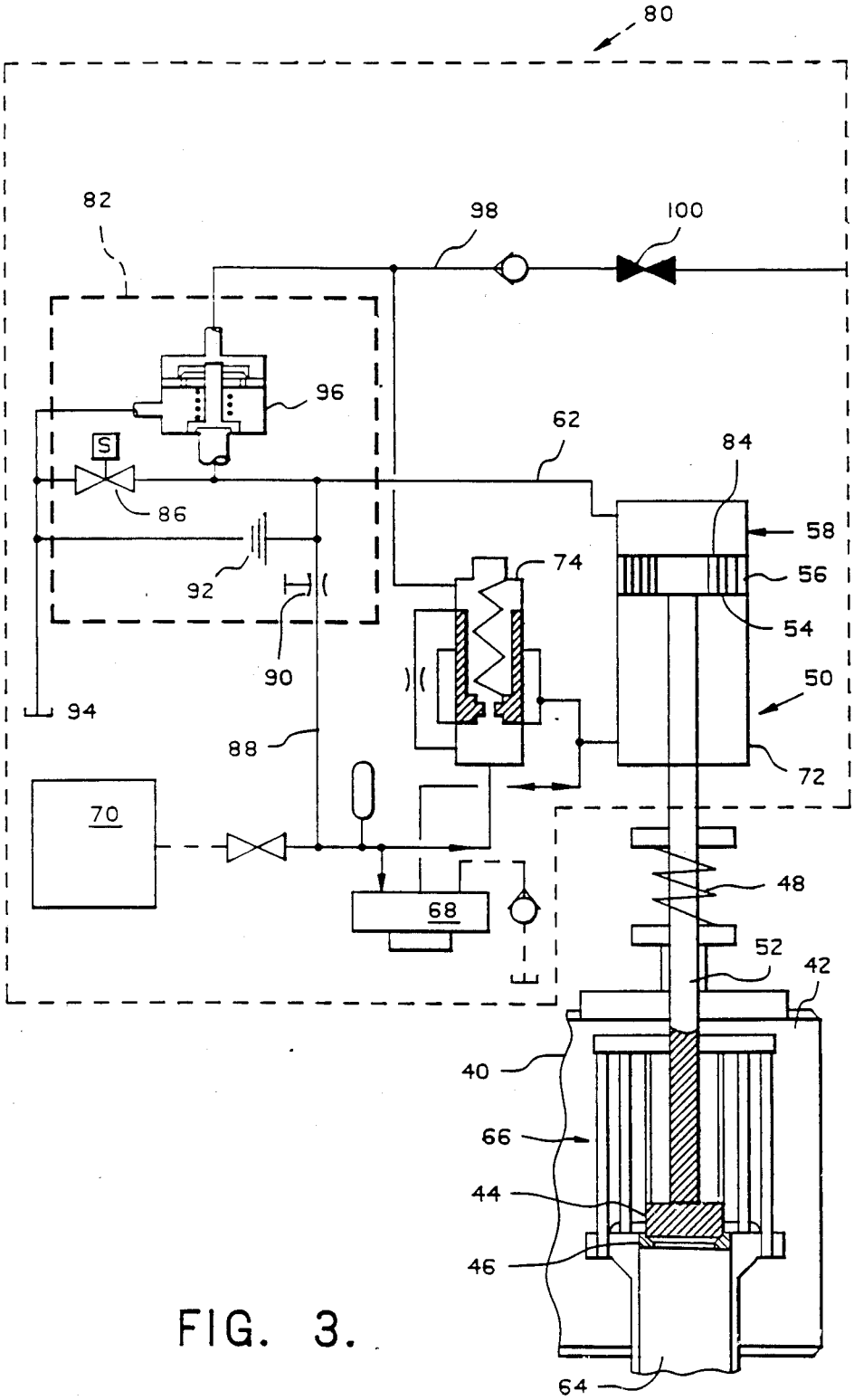
FIG. 3 is a schematic illustration of one form of the inventive valve system.

Referring now to FIG. 3 there is illustrated an improved valve system 80 in accordance with one form of the present invention, which improved system overcomes the aforedescribed problem of steam leakage through the valve seat 46. The inventive system 80 includes apparatus 82 for firmly seating the valve plug 44 after spring 48 moves the plug to a closed position.

In the preferred embodiment, a second seating force is provided by application of hydraulic pressure to a second side 84 of the piston 56. A solenoid valve 86 within the apparatus 82 determines the mode of operation of the system. With the solenoid valve 86 open, the system functions in the same manner as the conventional system 10 of FIG. 2. When the solenoid valve 86 is closed however, high pressure fluid from the supply 70 is coupled through fluid lines 88 and a controlled flow orifice 90 to a hydraulic line 62, which line 62 is connected to the first end 58 of the cylinder 50 above the piston 56. The orifice 90 restricts fluid flow so that the pressure on the second side 84 of the piston 56 can be regulated. Regulation of "holding" pressure is achieved by a relief valve 92 connected between the cylinder side of orifice 90 and a sump or drain 94. The relief valve 92 is of a type well known in the art such as one which can be set to open at selected pressures or one which provides a controlled leakage (assuming a constant pressure from the supply 70) to maintain a relatively constant pressure in the hydraulic lines 62.

In order to retain the fast opening characteristics of the single actuating valve system 10, the apparatus 82 incorporates a high volume dump valve 96 for bypassing the solenoid valve 86. The dump valve 96 is actuated by hydraulic fluid provided by a fluid line 98 from a trip valve 100. When the trip valve 100 pens, fluid pressure in the line 98 is relieved so that the spring action of the dump valve 96 allows it to rapidly open and relieve pressure in the hydraulic line 62. The dump valve 96 is obviously a fail-open valve which provides a large flow path for rapidly draining fluid from the second side 84 of the piston 56. The trip valve 100 is connected in circuit with the control system for the bypass valve 40 so that a trip command is applied to the trip valve 100 at the same time that a valve open command is applied to the servovalve system 68.

An improved valve control system and a method for eliminating leakage of high pressure fluid through a fast opening valve have been presented. It is contemplated that changes in the components and the arrangement of components in the novel system as well as changes in the precise steps of the method and the order of such steps may be made by those having ordinary skill in the art without departing from the spirit of the invention or the scope of the invention as set forth in the claims which follow.

We claim:

1. A steam bypass valve system for a steam turbine power generating system for increasing valve seating force without affecting valve opening response comprising:

(a) a normally closed single acting hydraulic valve including:

(i) a body member having an inlet port connected to a steam supply line and an outlet port connected to a steam return line;

(ii) a valve seat positioned within said body member adjacent said inlet port;

(iii) at least one movable plug positionable against said valve seat for closing said valve;

(iv) a valve stem connected at a first end to said plug and extending outwardly therefrom;

(v) at least one spring operatively coupled to said plug for providing a first closing force to close said valve by positioning said plug against said valve seat; and (b) a hydraulic actuating cylinder means operatively coupled to said valve stem for receiving a first hydraulic force independent of the steam passing through the valve for seating said plug against said valve seat after said valve is closed.

2. The valve system of claim 1 wherein said hydraulic cylinder has a first end and a second end, said valve stem extending through said second end, said cylinder further including a piston having a first side facing the second end of said cylinder and a second side facing the first end of said cylinder, said piston being operatively coupled to said valve stem so that movement of said piston toward the first end of said cylinder opens said valve and movement of said piston toward the second end of said cylinder closes said valve, said valve system further comprising:

(a) opening means for providing pressurized hydraulic fluid to the second side of said piston for opening said valve;

(b) means for selectively removing pressurized hydraulic fluid from the second side of said piston whereby said spring positions said plug against said valve seat; and (c) dump valve means for removing pressurized hydraulic fluid from the first end of said cylinder permitting quick opening of said valve when said opening means provides pressure to the first side of said piston.

3. The valve system of claim 2 and including:

(a) fluid means for providing high pressure hydraulic fluid to the second side of said piston;

(b) drain means for selectively receiving hydraulic fluid provided by said fluid means; and (c) regulating means for adjustably regulating the rate of fluid flowing from said fluid means to said drain means for regulating the pressure of the hydraulic fluid on the second side of said piston.

4. The valve system of claim 3 and including means for isolating pressure reductions caused by said dump valve means from said fluid means.

5. A control system for a steam turbine bypass valve connected for controlling high pressure steam, the valve being a normally closed valve having a body member, an inlet port and an outlet port, a valve seat positioned within said body member adjacent said inlet port, at least one movable plug positionable against said valve seat for blocking said inlet port, and a valve stem connected at a first end to said plug and extending outwardly from said body member, the system comprising:

(a) first closing means operatively coupled to said plug for providing a first closing force to close said valve by positioning said plug against said valve seat;

(b) hydraulic means operatively coupled to said valve stem for hydraulically opening said valve whereby said plug is positioned away from said valve seat and for hydraulically providing an additional seating force when said plug is positioned against said valve seat for minimizing leakage of the steam about said valve seat, said hydraulic means comprising:

(c) a hydraulic cylinder having a first end and a second end, a second end of said valve stem passing through the second end of said cylinder;

(d) a piston, having a first side facing the second end of said cylinder and a second side facing the first end of said hydraulic cylinder, said piston being movable within said cylinder being operatively coupled to said valve stem so that movement of said piston toward the first end of said cylinder opens said valve and movement of said piston toward the second end of said cylinder closes said valve, said additional seating force being provided by pressurized hydraulic fluid at the second side of said piston;

(e) opening means for opening said valve by providing pressurized hydraulic fluid to the first side of said piston;

(f) means for removing pressurized hydraulic fluid from the second side of said piston when said first closing force is provided;

(g) dump valve means for quickly removing pressurized hydraulic fluid from the second side of said piston when said opening means provides pressure to the first side of said piston;

(h) servovalve means for controlling flow of hydraulic fluid to and from the first side of said piston; and (i) means for providing pressurized hydraulic fluid to the second side of said piston.

* * * * *